US008544980B2

(12) United States Patent
Miyazawa

(10) Patent No.: US 8,544,980 B2
(45) Date of Patent: Oct. 1, 2013

(54) LIQUID EJECTING APPARATUS AND LIQUID EJECTING APPARATUS CONTROL METHOD

(75) Inventor: Makoto Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 285 days.

(21) Appl. No.: 13/168,300

(22) Filed: Jun. 24, 2011

(65) Prior Publication Data

US 2011/0316905 A1 Dec. 29, 2011

(30) Foreign Application Priority Data

Jun. 24, 2010 (JP) ..... 2010-143586

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS 5,132,729 A 7/1992 Matsushita et al.
2005/0046650 A1* 3/2005 Moriyama et al. ..... 347/7

FOREIGN PATENT DOCUMENTS

JP 03-220572 A 9/1991
JP 11-237816 A 8/1999
JP 2002-207401 * 7/2002
JP 2004-227012 A 8/2004

* cited by examiner

*Primary Examiner* — Julian Huffman
(74) *Attorney, Agent, or Firm* — Kilpatrick Townsend & Stockton LLP

(57) ABSTRACT

A liquid ejecting apparatus which is able to be mounted with a cartridge which is provided with a memory device which stores liquid usage information relating to a consumption amount or a remaining amount of liquid accommodated in the cartridge and a unique ID which uniquely distinguishes the cartridge. A control section executes a fault countermeasure process in relation to the memory device of the cartridge in a case where the relationship between a first liquid consumption amount obtained from the liquid usage information stored in the memory device of the cartridge mounted in the liquid ejecting apparatus and a second liquid consumption amount obtained from the liquid usage information stored in the non-volatile memory with regard to the cartridge is outside of a permitted range set in advance.

7 Claims, 8 Drawing Sheets

FIG. 4A

INITIAL STATE

BUSY LIST BUFFER BLB1

| No. | UNIQUE ID | INK CONSUMPTION AMOUNT |
|---|---|---|
| 01 | null | null |
| 02 | null | null |
| 03 | null | null |
| 04 | null | null |
| 05 | null | null |
| 06 | null | null |
| 07 | null | null |
| 08 | null | null |

BLA

BUSY LIST BUFFER BLB2

| No. | UNIQUE ID | INK CONSUMPTION AMOUNT |
|---|---|---|
| 01 | null | null |
| 02 | null | null |
| 03 | null | null |
| 04 | null | null |
| 05 | null | null |
| 06 | null | null |
| 07 | null | null |
| 08 | null | null |

FIG. 4B

BUSY LIST BUFFER BLB1 IS FULL

BUSY LIST BUFFER BLB1

| No. | UNIQUE ID | INK CONSUMPTION AMOUNT |
|---|---|---|
| 01 | aaaa | new |
| 02 | bbbb | new |
| 03 | cccc | new |
| 04 | bbbb | 10.3% |
| 05 | aaaa | 10.2% |
| 06 | bbbb | 30.6% |
| 07 | ssss | new |
| 08 | bbbb | 50.1% |

BLA

BUSY LIST BUFFER BLB2

| No. | UNIQUE ID | INK CONSUMPTION AMOUNT |
|---|---|---|
| 01 | null | null |
| 02 | null | null |
| 03 | null | null |
| 04 | null | null |
| 05 | null | null |
| 06 | null | null |
| 07 | null | null |
| 08 | null | null |

BLA

RECONFIGURATION

FIG. 4C

CONTENT OF BUSY LIST BUFFER BLB1 IS RECONFIGURED IN BUSY LIST BUFFER BLB2

BUSY LIST BUFFER BLB1

| No. | UNIQUE ID | INK CONSUMPTION AMOUNT |
|---|---|---|
| 01 | aaaa | new |
| 02 | bbbb | new |
| 03 | cccc | new |
| 04 | bbbb | 10.3% |
| 05 | aaaa | 10.2% |
| 06 | bbbb | 30.6% |
| 07 | ssss | new |
| 08 | bbbb | 50.1% |

BUSY LIST BUFFER BLB2

| No. | UNIQUE ID | INK CONSUMPTION AMOUNT |
|---|---|---|
| 01 | aaaa | 10.2% |
| 02 | bbbb | 50.1% |
| 03 | cccc | new |
| 04 | ssss | new |
| 05 | null | null |
| 06 | null | null |
| 07 | null | null |
| 08 | null | null |

BLA

FIG. 4D

BUSY LIST BUFFER BLB2 IS FULL

BUSY LIST BUFFER BLB1

| No. | UNIQUE ID | INK CONSUMPTION AMOUNT |
|---|---|---|
| 01 | aaaa | new |
| 02 | bbbb | new |
| 03 | cccc | new |
| 04 | bbbb | 10.3% |
| 05 | aaaa | 10.2% |
| 06 | bbbb | 30.6% |
| 07 | ssss | new |
| 08 | bbbb | 50.1% |

BLA

BUSY LIST BUFFER BLB2

| No. | UNIQUE ID | INK CONSUMPTION AMOUNT |
|---|---|---|
| 01 | aaaa | 10.2% |
| 02 | bbbb | 50.1% |
| 03 | cccc | new |
| 04 | ssss | new |
| 05 | cccc | 10.3% |
| 06 | bbbb | 70.7% |
| 07 | bbbb | 90.6% |
| 08 | bbbb | end |

BLA

FIG. 5A

BUSY LIST BUFFER BLB2 IS FULL

BUSY LIST BUFFER BLB1

| No. | UNIQUE ID | INK CONSUMPTION AMOUNT |
|---|---|---|
| 01 | aaaa | new |
| 02 | bbbb | new |
| 03 | cccc | new |
| 04 | bbbb | 10.3% |
| 05 | aaaa | 10.2% |
| 06 | bbbb | 30.6% |
| 07 | ssss | new |
| 08 | bbbb | 50.1% |

BLA

BUSY LIST BUFFER BLB2

| No. | UNIQUE ID | INK CONSUMPTION AMOUNT |
|---|---|---|
| 01 | aaaa | 10.2% |
| 02 | bbbb | 50.1% |
| 03 | cccc | new |
| 04 | ssss | new |
| 05 | cccc | 10.3% |
| 06 | bbbb | 70.7% |
| 07 | bbbb | 90.6% |
| 08 | bbbb | end |

BLA

RECONFIGURATION

FIG. 5B

CONTENT OF BUSY LIST BUFFER BLB2 IS RECONFIGURED IN BUSY LIST BUFFER BLB1

BUSY LIST BUFFER BLB1

| No. | UNIQUE ID | INK CONSUMPTION AMOUNT |
|---|---|---|
| 01 | aaaa | 10.2% |
| 02 | cccc | 10.3% |
| 03 | ssss | new |
| 04 | null | null |
| 05 | null | null |
| 06 | null | null |
| 07 | null | null |
| 08 | null | null |

BLA

BUSY LIST BUFFER BLB2

| No. | UNIQUE ID | INK CONSUMPTION AMOUNT |
|---|---|---|
| 01 | aaaa | 10.2% |
| 02 | bbbb | 50.1% |
| 03 | cccc | new |
| 04 | ssss | new |
| 05 | cccc | 10.3% |
| 06 | bbbb | 70.7% |
| 07 | bbbb | 90.6% |
| 08 | bbbb | end |

LIQUID EJECTING APPARATUS AND LIQUID EJECTING APPARATUS CONTROL METHOD

BACKGROUND

1. Technical Field

The present invention relates to a liquid ejecting apparatus, which is able to be mounted with a cartridge, and a liquid ejecting apparatus control method.

2. Related Art

In recent years, as printing device cartridges, cartridges that are mounted with a memory device which stores information relating to ink (for example, the remaining amount of ink) are used. In many cases, in the memory device of the cartridge, an ID which distinguishes individual cartridges is stored. In the past, a printing device has been proposed (JP-A-1991-220572, JP-A-11-237816, and JP-A-2004-227012) where the mounting of unsuitable cartridges is prevented by registering the ID of the mounted cartridge.

However, typically, there is a possibility that a fault such as a memory error will be generated in the memory device. If a memory error is generated in the memory device of the cartridge, there is a possibility that the printing device is not able to correctly perform processing in relation to the cartridge (for example, calculation of the remaining amount of ink or determination of whether the cartridge needs to be replaced). However, in the related art, with regard to countermeasures in the case where a fault such as a memory error is generated in a circuit included in the memory device of the cartridge, it was the case that there was no sufficient mechanism.

Additionally, in the past, there has been a desire for correctly determining whether or not a new cartridge has been mounted, and after that, to reliably perform appropriate processing (such as a process of filling ink into the printing head) using the ID stored in the memory device of the cartridge.

In addition, the various problems described above are not limited to the printing device and are common to liquid ejecting apparatuses which are able to be mounted with a cartridge.

SUMMARY

An advantage of some aspects of the invention is that a technique is provided where it is possible to take appropriate countermeasures in a case where a fault is generated in a circuit included in a memory device of the cartridge, and a technique is provided where it is possible to reliably determine whether or not a new cartridge has been mounted using an ID stored in the memory device of the cartridge.

It is possible to realize the invention as the embodiments and application examples below.

Application Example 1

According to this application example of the invention, there is provided a liquid ejecting apparatus, which is able to be mounted with a cartridge which is provided with a memory device which stores liquid usage information relating to a consumption amount or a remaining amount of liquid accommodated in the cartridge and a unique ID which uniquely distinguishes the cartridge, and which is provided with a non-volatile memory for storing cartridge information including the unique ID of the cartridge and the liquid usage information relating to the cartridge mounted one or more times in the liquid ejecting apparatus and a control section which controls a plurality of circuits including the non-volatile memory and the memory device of the cartridge mounted in the liquid ejecting apparatus, where the control section executes a fault countermeasure process in relation to the memory device of the cartridge in a case where the relationship between a first liquid consumption amount obtained from the liquid usage information stored in the memory device of the cartridge mounted in the liquid ejecting apparatus and a second liquid consumption amount obtained from the liquid usage information stored in the non-volatile memory with regard to the cartridge is outside of a permitted range set in advance.

According to the configuration, it is possible to determine whether or not there is a possibility that a fault will be generated in the circuits included in the memory device of the cartridge according to whether or not the relationship between the first and second liquid consumption amounts is outside of the permitted range set in advance. Additionally, in the case where there is the possibility that a fault will be generated, it is possible to execute an appropriate fault countermeasure process in relation to the memory device. Furthermore, it is possible to correctly determine whether or not a new cartridge has been mounted since the unique ID of the cartridge mounted one or more times in the liquid ejecting apparatus is stored in the non-volatile memory of the liquid ejecting apparatus.

Application Example 2

In regard to the liquid ejecting apparatus of application example 1, the control section performs writing which updates the liquid usage information more frequently in the memory device of the cartridge than in the non-volatile memory, and in a case where the second liquid consumption amount is larger than the first liquid consumption amount, the control section determines that the relationship between the first and second liquid consumption amounts is outside of the permitted range and executes an appropriate fault countermeasure process.

According to the configuration, in a case where the second liquid consumption amount with a low updating frequency is larger than the first liquid consumption amount with a high updating frequency, since it is possible to determine that there is an error in the liquid usage information stored in the memory device of the cartridge, it is possible to execute an appropriate fault countermeasure process in relation to the memory device.

Application Example 3

In regard to the liquid ejecting apparatus of application example 2, the control section executes a process of storing the liquid usage information, which is stored in the non-volatile memory, in the memory device of the cartridge as the fault countermeasure process.

According to the configuration, it is possible to rewrite incorrect liquid usage information stored in the memory device of the cartridge with more accurate liquid usage information.

Application Example 4

In regard to the liquid ejecting apparatus of any one of application examples 1 to 3, the non-volatile memory is a flash memory, and the control section adds a grouping of the unique ID of the cartridge and the liquid usage information in the flash memory as a new grouping of the cartridge information only when the consumption amount or the remaining amount of the liquid relating to the cartridge mounted in the liquid ejecting apparatus has reached a plurality of prescribed values set in advance.

According to the configuration, it is possible to reduce the number of times of writing into the flash memory, and it is possible to also reduce the number of times of deleting a sector which is required in a case when the flash memory is full.

Application Example 5

In regard to the liquid ejecting apparatus of any one of application examples 1 to 4, the flash memory has a plurality of sectors, and the control section selects one out of the plurality of sectors as a writing sector and executes an addition of the cartridge information, and in a case when the writing sector has become full, (i) only the latest cartridge information of each unique ID is selected out of a plurality of groups of cartridge information stored in the writing sector and (ii) the selected cartridge information is written into a sector which is next after the writing sector and the next sector is selected as the new writing sector.

According to the configuration, in the case when one sector has become full, since the next sector is reconfigured with only the latest cartridge information, it is possible to write into the next sector only the minimum required cartridge information. Additionally, since the same information as the reconfigured latest cartridge information also remains in the previous writing sector, even if an unexpected situation occurs such as a loss of power when the next sector is being deleted or the like, it is possible to prevent a loss of the latest cartridge information.

Application Example 6

In regard to the liquid ejecting apparatus of application example 5, in a case where the writing sector has become full, the control section deletes the cartridge information, which shows that the liquid usage information has exceeded the upper limit value of the consumption amount of the liquid, and the cartridge information, which includes the unique ID which is the same as the cartridge information out of the plurality of groupings of cartridge information stored in the writing sector, from the cartridge information which is to be written into the next sector.

According to the configuration, it is possible to further reduce the latest cartridge information which is to be written into the next sector and it is possible to more effectively use the flash memory.

In addition, it is possible to realize the invention with various formations, and it is possible for the invention to be realized in the form of a printing device, a liquid ejecting apparatus, control methods of such devices, a computer program for realizing these methods or functions of a device, a recording medium which records the computer program, or the like. Furthermore, in the invention, the "recording medium" has a meaning of a substantive recording medium such as a DVD or a hard disk.

BRIEF DESCRIPTION OF THE DRAWINGS

The invention will be described with reference to the accompanying drawings, wherein like numbers reference like elements.

FIGS. 4A to 4D are explanatory diagrams illustrating processing content of busy list updating.

FIGS. 5A and 5B are explanatory diagrams illustrating processing content of busy list updating.

DESCRIPTION OF EXEMPLARY EMBODIMENTS

Figure 1:
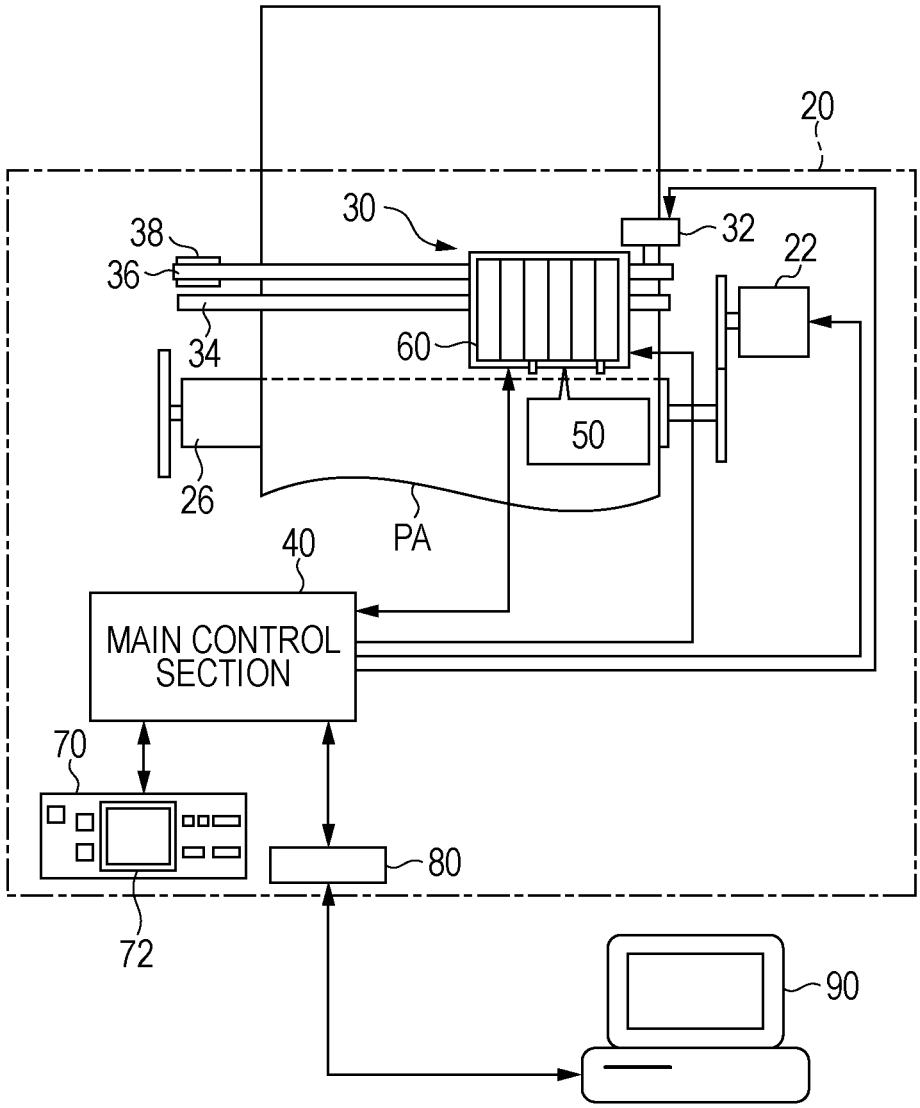
FIG. 1 is an explanatory diagram illustrating a schematic configuration of a printing system.

FIG. 1 is an explanatory diagram illustrating a schematic configuration of a printing system. The printing system is provided with a printer 20 as a printing device and a computer 90. The printer 20 is connected to the computer 90 via a connector 80.

The printer 20 is provided with a sub scanning and feeding mechanism, a main scanning and feeding mechanism, a head driving mechanism, and a main control section 40. The sub scanning and feeding mechanism is provided with a paper feeding motor 22 and a paper feeding roller 26, and a sheet of paper PA is transported in a sub scanning direction using the paper feeding roller 26. The main scanning and feeding mechanism is provided with a carriage motor 32, a pulley 38, a driving belt 36 which extends between the carriage motor and the pulley, and a sliding axis 34 provided in parallel with the axis of the paper feeding roller 26. The sliding axis 34 supports the carriage 30, which is fixed to the driving belt 36, so as to be able to slide. The rotation of the carriage motor 32 is transmitted to the carriage 30 via the driving belt 36, and the carriage 30 reciprocates along the sliding axis 34 in a main scanning direction which is parallel to an axial direction of the paper feeding roller 26. The head driving mechanism is provided with a printing head unit 60 mounted on the carriage 30, drives the printing head, and discharges ink onto the paper PA. The main control section 40 controls each of the mechanisms described above and executes a printing process. For example, the main control section 40 receives a printing job from a user via the computer 90, controls each of the mechanisms described above, and executes printing based on the contents of the received printing job. The printing head unit 60 has a sub control section 50 which cooperates with the main control section 40 and executes various controls. In the printing head unit 60, a printing head is provided which has a plurality of nozzle rows which respectively discharge different inks. Additionally, in a holder provided in an upper portion of the printing head unit 60, a plurality of ink cartridges which respectively accommodates different inks is able to be mounted so as to be removable. The printer 20 is further provided with an operation section 70 for the user to perform various settings of the printer 20 and to confirm the status of the printer 20. The operation section 70 is provided with a display section 72 for performing various notifications to the user.

Figure 2:
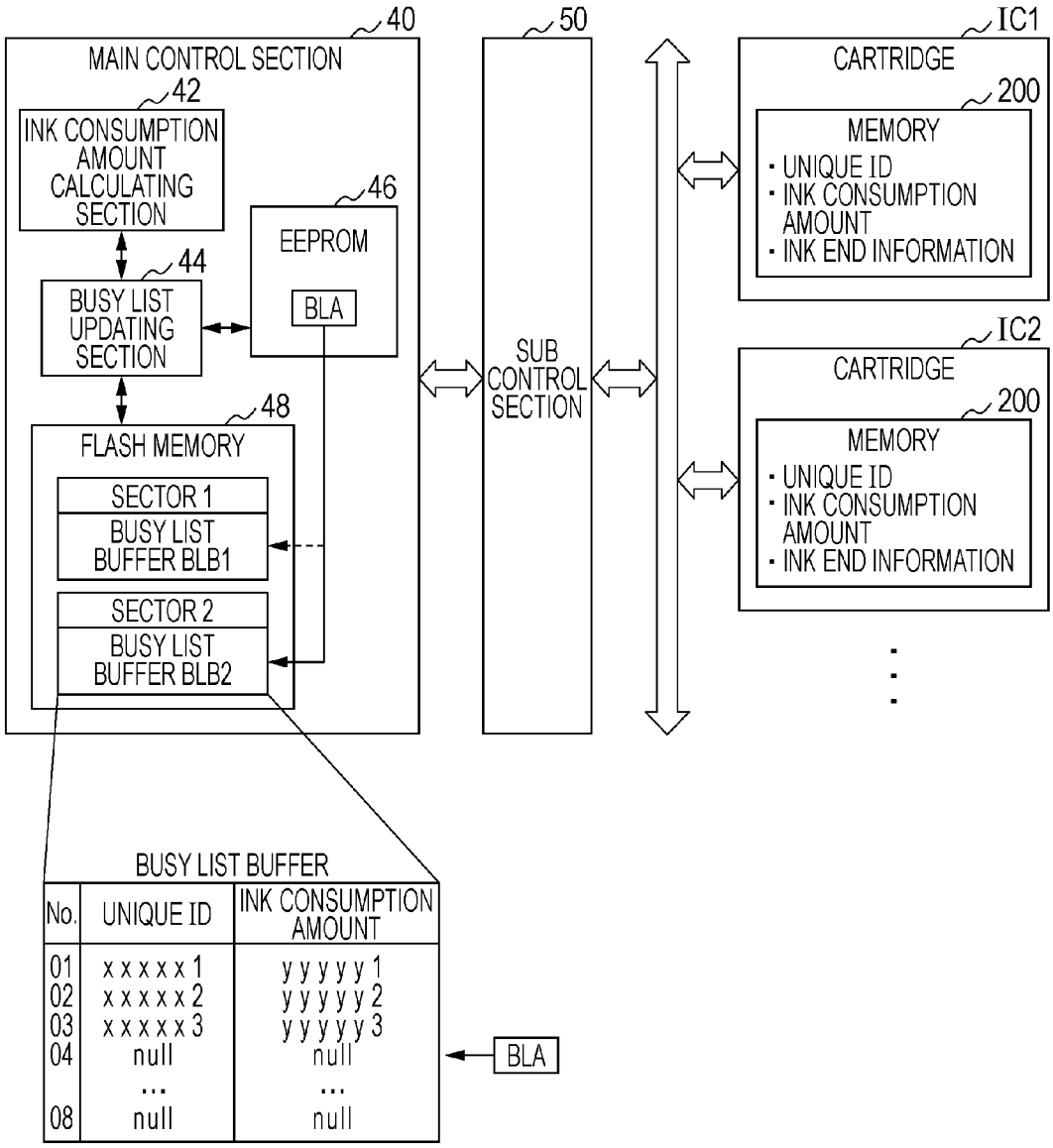
FIG. 2 is a functional block diagram of a main control section, a sub control section, and an ink cartridge.

FIG. 2 is a functional block diagram of the main control section 40, the sub control section 50, and ink cartridges IC1 and IC2. Here, only the main functional blocks, which perform processing in relation to the unique ID of the ink cartridge and the ink consumption amount, are depicted. In addition, below, the ink cartridge is simply called the "cartridge".

The individual cartridges IC1, IC2, . . . have a memory device 200 configured by a non-volatile memory. In the memory device 200, the unique ID which uniquely distinguishes the cartridge is stored in advance. Additionally, when ink is consumed from the inside of the cartridge, the ink consumption amount (or remaining amount of ink) and ink end information are stored in the memory device 200. "Ink end information" is information showing that the ink consumption amount of the cartridge has exceeded an upper limit (for example, 99%) set in advance. In addition, it is possible to not include the ink end information in the memory device 200.

The main control section 40 is provided with an ink consumption amount calculating section 42, a busy list updating section 44, an EEPROM 46 (EEPROM is a registered trademark), and a flash memory 48. The flash memory 48 has two sectors and the sectors are used as busy list buffers BLB1 and BLB2. The busy lists stored in the busy list buffers BLB1 and BLB2 are lists where cartridge information including the unique ID and the ink consumption amount are registered in relation to the cartridge mounted in the printer 20 one or more times. In the EEPROM 46, a busy list address BLA is stored which shows a writing location in the flash memory 48. The busy list address BLA is used by being copied onto a main memory (not shown) of the main control section 40 after the power of the printer 20 is turned on.

The ink consumption amount calculating section 42 calculates the ink consumption amount of each cartridge which is consumed in a printing process or a printing head cleaning process. The busy list updating section 44 updates the busy list in the flash memory 48 based on the ink consumption amount calculated by the ink consumption amount calculating section 42. In the updating of the busy list, new cartridge information is added to the address specified by the busy list address BLA and the busy list address BLA is counted up. Then, in a case when one sector becomes full, the next sector is selected as the new writing sector. In the case when the flash memory 48 has only two sectors as shown in FIG. 2, the sectors are selected as the writing sector in turns. In addition, typically, the deleting of the writing content of the flash memory is performed in sector units, and also, the deleting requires a considerably long time compared to other memories such as the EEPROM. Therefore, it is preferable that the updating of the busy list in the flash memory 48 is performed only when the ink consumption amount (or the remaining amount of ink) has exceeded any of a plurality of prescribed values set in advance (for example, 10%, 30%, 50%, 70%, and 90%). According to this, it is possible to reduce the number of times that the sectors become full and the number of times that the sectors are deleted. Here, the ink consumption amount calculating section 42 and the busy list updating section 44 are realized by, for example, a CPU in the main control section 40 executing a program. Instead, the ink consumption amount calculating section 42 and the busy list updating section 44 may also be realized by hardware circuits.

Figure 3:
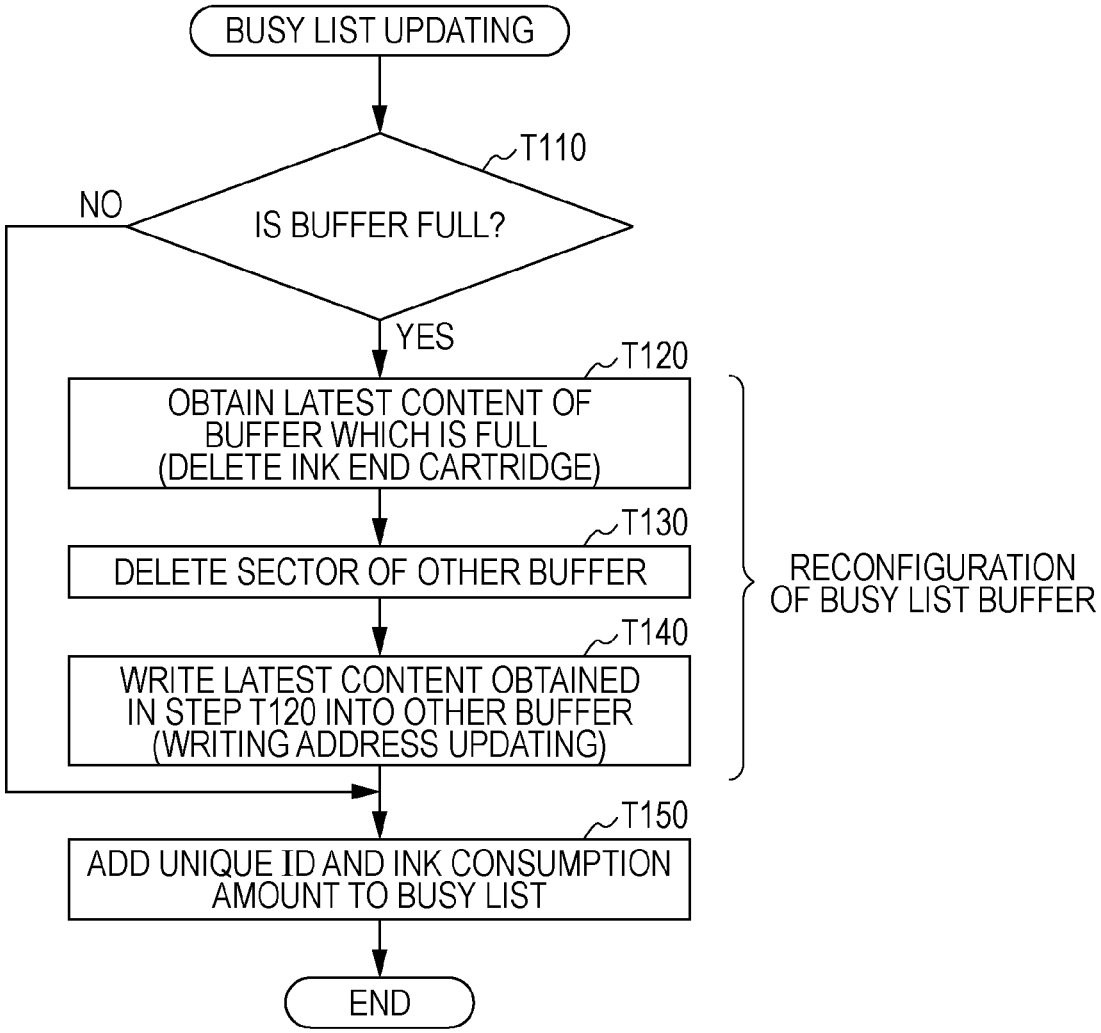
FIG. 3 is a flow chart illustrating a processing sequence of busy list updating.

FIG. 3 is a flow chart illustrating a processing sequence of busy list updating and FIGS. 4A to 5B are explanatory diagrams illustrating processing content of busy list updating. FIG. 4A shows an initial state of the busy list buffer. Here, cartridge information is stored in neither of the two busy list buffers BLB1 and BLB2. Here, the text "NULL" has a meaning of information which is not valid. In this example, to simplify the description, the busy list buffers BLB1 and BLB2 each only have eight storage locations. The initial busy list address BLA shows an initial address of the first busy list buffer BLB1. That is, in the initial state, the first busy list buffer BLB1 is selected as the writing buffer (writing sector) and the cartridge information is sequentially added to the busy list buffer BLB1.

FIG. 4B shows a state where the first busy list buffer BLB1 has become full. That is, when the cartridge information is added to the last address of the first busy list buffer BLB1, the busy list address BLA moves to the front address of the second busy list buffer BLB2. In this example, in the first busy list buffer BLB2, the cartridge information relating to the unique IDs of four cartridges "aaaa", "bbbb", "cccc", and "ssss" is stored. As the ink consumption amount in each of the cartridge information, that it is a new cartridge (consumption amount of zero) and a calculated value of the ink consumption amount at a point in time when the ink consumption amount exceeds any of the plurality of prescribed values (10%, 30%, 50%, 70%, and 90%) are sequentially registered. In addition, it is possible to not include the registration that it is a new cartridge (consumption amount of zero).

In step T110 of FIG. 3, it is determined whether or not the writing buffer (writing sector) in the flash memory 48 has become full. Whether or not the writing buffer has become full can be determined by, for example, whether or not the busy list address BLA has moved to the front address of the next sector (FIG. 4B). In the case where the writing buffer has not become full, the flow of processes is moved to step T150, and one grouping of the cartridge information configured by the unique ID and the ink consumption amount is added to the position of the busy list address BLA. On the other hand, in the case where the writing buffer has become full, a busy list buffer reconfiguring process is executed in steps T120 to T140.

In step T120, from the busy list buffer that has become full, only the latest cartridge information relating to each unique ID is selected. For example, in a state of FIG. 4B, the latest cartridge information relating to the unique ID "aaaa" is where the ink consumption amount is 10.2%. In the same manner, the latest cartridge information relating to the other unique IDs "bbbb", "cccc", and "ssss" is where the ink consumption amounts are respectively 50.1%, new (0%), and new (0%). In addition, in a case where the ink consumption amount is ink end, it is preferable if all of the cartridge information relating to the unique ID is removed from the selection target. The reason is because, since the cartridge which has reached ink end does not require further management of the ink consumption amount, it is possible for the flash memory 48 to be more effectively used by not registering the cartridge information in the next sector.

In step T130, the sector of the other buffer (the second busy list buffer BLB2 in the example in FIG. 4B) is deleted. Then, in step T140, the latest cartridge information obtained in step T120 is added to the front of the other buffer. FIG. 4C shows a state after such a busy list buffer reconfiguration. That is, in the front of the second busy list buffer BLB2, the latest cartridge information relating to the four unique IDs "aaaa", "bbbb", "cccc", and "ssss" is written in and the busy list address BLA is set to the next address position. After that, the new cartridge information is added to the position of the busy list address BLA (step T150).

FIG. 4D shows a state where the second busy list buffer BLB2 has become full. At this time, the busy list buffer reconfiguration process is executed again with steps T120 to T140 of FIG. 3. FIG. 5A shows the same state as FIG. 4D and FIG. 5B shows a state after the busy list buffer reconfiguration process. Here, only the latest cartridge information relating to each unique ID is selected out of the cartridge information stored in the second busy list buffer BLB2 of FIG. 5A, the content of the first busy list buffer BLB1 is all deleted at once, and only the latest cartridge information of the second busy list buffer BLB2 is registered in the front of the first busy list buffer BLB1. However, in FIG. 5A, with regard to the unique ID "bbbb", since the cartridge information is included which is a value "end" showing that the ink consumption amount is ink end, the cartridge information with the unique ID "bbbb" is removed from the cartridge information reconfigured in the first busy list buffer BLB1.

In this manner, in the busy list updating process of the embodiment, when the sector (busy list buffer) which has become the writing target out of the plurality of sectors in the flash memory has become full, only the latest cartridge information of each unique ID is selected out of the plurality of groupings of cartridge information stored in the writing sector, and the latest cartridge information is written into the other sector and the other sector is selected as the new writing sector. In this manner, since the next sector is reconfigured with only the latest cartridge information, it is possible to only write the minimum required cartridge information into the next sector. Furthermore, since the same information as the reconfigured latest cartridge information also remains in the previous writing sector, even if an unexpected situation occurs such as a loss of power (for example, the power plug is pulled out) when the next sector is being deleted or the like, it is possible to prevent a loss of the latest cartridge information.

In addition, since the deleting of the stored content of the sector of the flash memory 48 takes a considerably long time, there is a possibility that the stored content of the sector is inappropriate if there is a loss of power in the printer 20 during deleting. Therefore, during deleting of a sector, a flag which shows that the sector is being deleted may be registered in the EEPROM 46 and the flag may be deleted after the completion of the deleting of the sector. In this manner, even in the case where there is a loss of power in the printer 20 during deleting of the sector, it is possible to execute the deleting of the sector again after the printer 20 is restarted.

Additionally, in the busy list updating process of the embodiment, since the cartridge information which shows the ink consumption is ink end and the cartridge information including the same unique ID as the cartridge information is removed from the latest cartridge information to be written into the next sector, it is possible to effectively use the storing content of the flash memory.

Furthermore, in the busy list updating process of the embodiment, the unique ID and the ink consumption amount of the cartridge are added in the flash memory as a new grouping of cartridge information only when the ink consumption amount of the cartridge mounted in the printing device reaches any of the plurality of prescribed values set in advance. Accordingly, it is possible to limit the number of times of writing into the flash memory to the smallest possible number of times.

Here, the reason for storing the busy list in the flash memory and not in the EEPROM is because the flash memory is cheaper. However, the busy list may be stored in a different type of non-volatile memory other than the flash memory.

Here, in regard to the fourth unique ID "ssss" out of the four unique IDs "aaaa", "bbbb", "cccc", and "ssss" shown in FIGS. 4A to 5B, there is no additional registering of cartridge information after the cartridge information is registered in the busy list buffer during new mounting. A state such as this occurs in a case where, for example, after the cartridge with the unique ID "ssss" is mounted instead of another cartridge (for example, the cartridge with the unique ID "cccc"), the cartridge is removed from the printer 20 when it has hardly been used for printing. Also in such a case, since the cartridge information relating to the unique ID "ssss" remains in the busy list buffer, afterwards, when the cartridge with the unique ID "ssss" is mounted again, it is possible to correctly determine that it is not a completely new cartridge. In addition, with regard to the cartridge which is mounted again after being removed once, a cleaning process when remounting (ink filling process) may be performed when remounting. In addition, to determine whether or not it is a remounting, the unique ID of the cartridge when mounting may be registered in the EEPROM 46.

Figure 6:
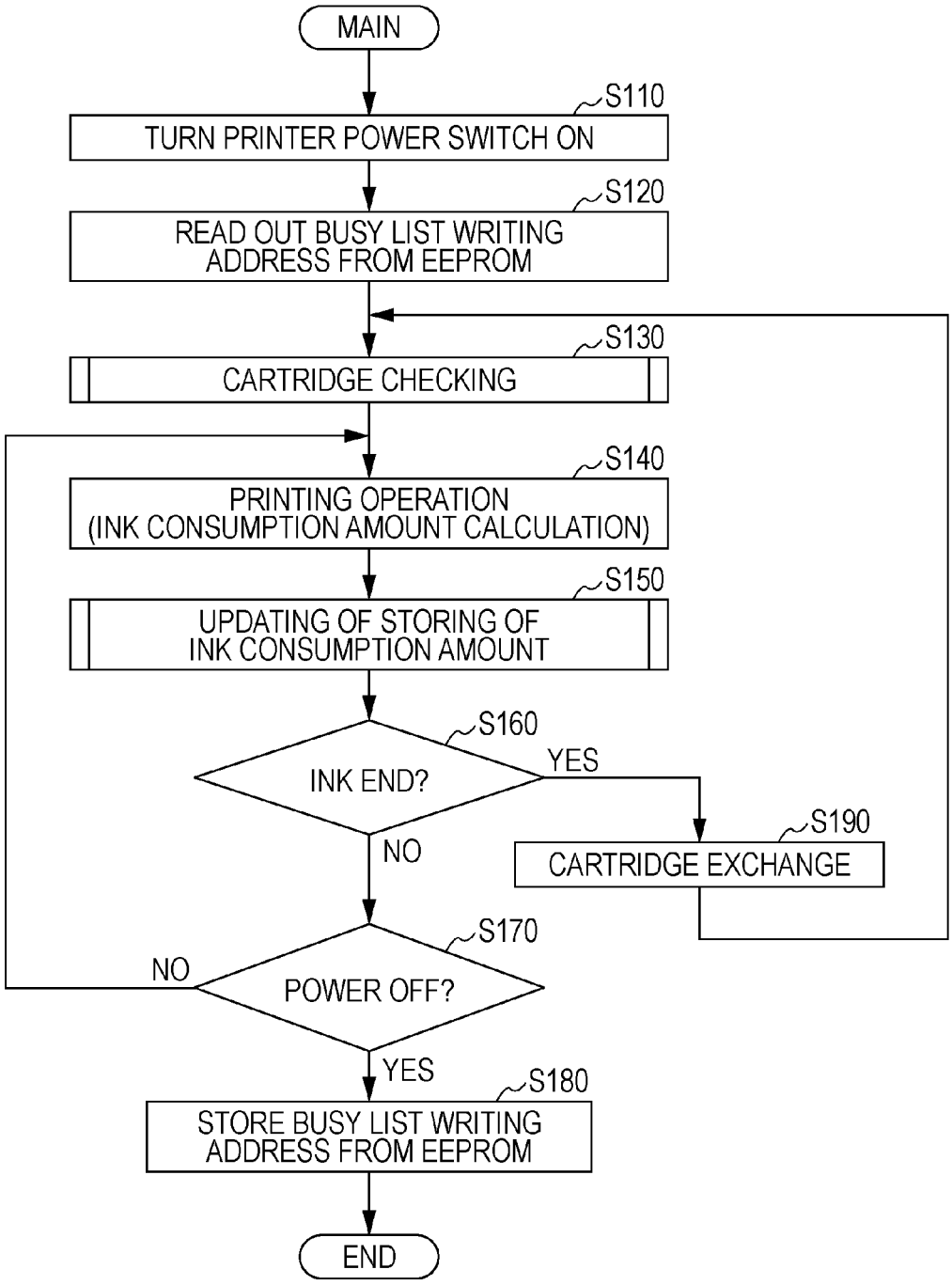
FIG. 6 is a flow chart illustrating an overall processing sequence of a printer in relation to updating of an ink consumption amount.

FIG. 6 is a flow chart illustrating an overall processing sequence of a printer in relation to updating of the busy list buffer. When the power switch of the printer is inserted by a user in step S110, the busy list updating section 44 reads out the busy list address BLA from the EEPROM 46 in step S120 and cartridge checking is executed with the individual cartridges as targets in step S130.

Figure 7:
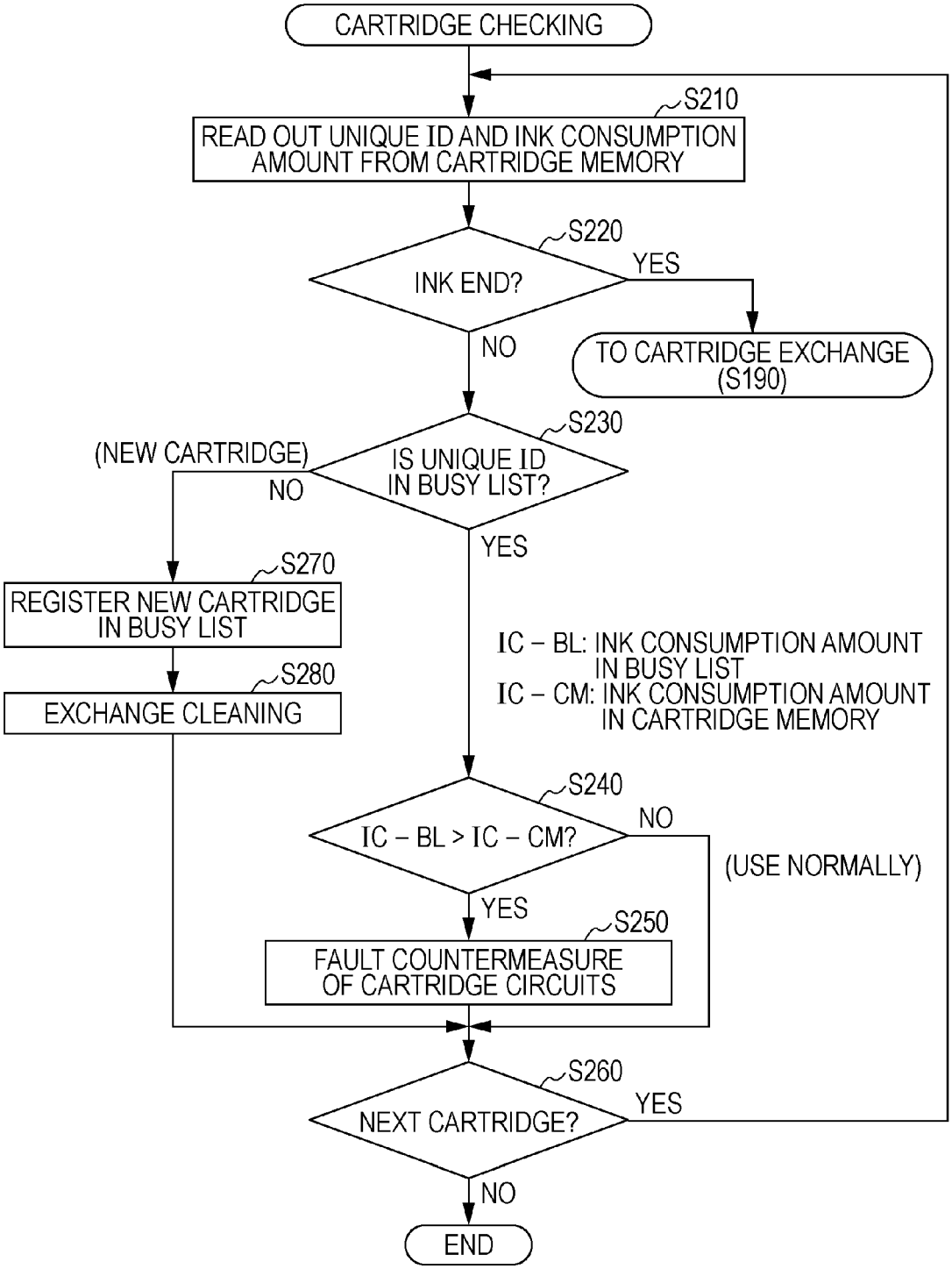
FIG. 7 is a flow chart illustrating a detailed sequence of cartridge checking.

FIG. 7 is a flow chart illustrating a detailed sequence of cartridge checking. In step S210, the main control section 40 reads out the unique ID and the ink consumption amount from the memory device 200 of the cartridge which is the target of the cartridge checking. In step S220, the main control section 40 determines whether or not the read-out ink consumption information shows ink end. In the case when it is ink end, a display prompting the exchanging of the cartridge is displayed on the display section 72 of the printer 20 or a screen of the computer 90. On the other hand, in the case when it is not ink end, the busy list updating section 44 determines whether or not the unique ID read out from the memory device 200 of the cartridge is registered in the busy list in step S230. In the case where the read-out unique ID is not registered in the busy list (two busy list buffers BLB1 and BLB2), it is possible to determine that a completely new cartridge has been mounted. Therefore, in this case, the busy list updating section 44 registers the cartridge information (FIG. 4B) showing that it is a new cartridge in the busy list in step S270. However, it is possible to not include the registering of the new cartridge. In step S280, the main control section 40 executes exchange cleaning. The exchange cleaning is mainly for filling ink into an ink path between from an ink supply port of the cartridge to a nozzle of the printing head and is one type of cleaning of the printing head. For example, the exchange cleaning includes a process of sucking ink from a head surface of the printing head which is performed using a pump, a process of discharging ink which is performed by driving the printing head, and a process of wiping the head surface which is performed by moving a wiper blade. If the exchange cleaning is not performed, there is a possibility that bubbles are mixed into the ink path and there are missing dots.

So as to be able to understand from the description of steps S230, S270 and S280 described above, since the cartridge information which includes the unique ID which uniquely distinguishes the cartridge and the ink consumption amount are sequentially stored in the busy list buffer, it is possible to correctly recognize the cartridge where the unique ID is not registered in the busy list as a new cartridge. Accordingly, it is possible to correctly perform the exchange cleaning (process of filling ink into the ink path) to be executed in the case where a new cartridge is mounted. As a result, it is possible to prevent missing dots which are caused by the exchange cleaning not being correctly performed.

In the case where the unique ID is registered in the busy list in step S230, with regard to the unique ID, a latest ink consumption amount IC-BL registered in the busy list and an ink consumption amount IC-CM which is read out from the memory device 200 of the cartridge are compared in step S240. As described previously, the ink consumption amount is registered in the busy list only at a timing when it has exceeded any of the plurality of prescribed values set in advance (for example, 10%, 30%, 50%, 70%, and 90%). On the other hand, at a predetermined timing including the turning off of the printer, the latest ink consumption amount is written into the memory device 200 of the cartridge more frequently than the updating of the busy list. Accordingly, the ink consumption amount IC-BL registered in the busy list is normally equal to or less than the ink consumption amount IC-CM which is stored in the cartridge memory. Therefore, in a case where IC-BL≤IC-CM, it is determined that the relationship between IC-BL and IC-CM is normal and the flow of processes is moved to step S260. On the other hand, in a case where IC-BL>IC-CM, it is considered that there is a fault in either the flash memory 48 (or periphery circuits) or the memory device 200 of the cartridge (or periphery circuits). Normally, there is a high possibility that the fault is generated in the circuits including the memory device 200 of the cartridge rather than the flash memory 48. The reason is because there is a possibility that a fault is caused in the memory circuit which is generated by a connection defect such as a short circuit when the cartridge is mounted in a holder of the printer or a high voltage causes a fault in the memory circuit when a high voltage is applied to the circuits of the cartridge for detecting the remaining amount of ink in the cartridge or detecting the mounting of a cartridge. Therefore, in the case where IC-BL>IC-CM, the main control section 40 determines that a fault has been generated in the circuits including the memory of the cartridge and a process is executed which is set in advance as the fault countermeasure process in relation to the memory device 200 in step S250.

It is possible to adopt various processes as the fault countermeasure process, and for example, it is possible to set in advance so that one or more of the processes below are executed.

(1) The ink consumption amount IC-CM is read out again from the memory device 200 of the cartridge. (2) The ink consumption amount IC-BL which is registered in the busy list is written into the memory device 200 of the cartridge. (3) A display prompting the exchange of the cartridge or the remounting of the cartridge is displayed on the display section 72 of the printer 20 or a screen of the computer 90.

The reason for performing the process (1) is because, in a case where there is a terminal communication error between the printer and the cartridge, there is a possibility that the correct ink consumption amount can be obtained from the memory device 200 of the cartridge by being read out again. In a case when the correct ink consumption amount is obtained by being read out again, it is not necessary to perform the processes (2) or (3). If the process (2) is performed, it is possible for an incorrect ink consumption amount stored in the memory device 200 of the cartridge to be revised to a more accurate ink consumption amount. The reason for performing the process (3) is because, in a case where the cause of an ink consumption amount error of the cartridge memory is a communication error due to a connection defect, there is a possibility that the terminal connection default or the like is resolved by the same cartridge being removed and mounted again. Here, in a case where the exchange or the remounting of the cartridge is performed, the process from step S210 is started again with regard to the cartridge.

In step S260, it is determined whether or not the cartridge checking in relation to all of the cartridges has been completed, and in a case where there is a cartridge remaining, the processes after step S210 are executed in relation to the next cartridge.

In this manner, in the cartridge checking of the embodiment, in the case where the ink consumption amount IC-BL registered in the busy list is a larger value than the ink consumption amount IC-CM stored in the cartridge memory, since it is determined that a fault has been generated in the circuits including the cartridge memory, it is possible to prevent further processes from continuously using the erroneous ink consumption amount. In the embodiment, as described in FIG. 4, the cartridge information including the ink consumption amount is additionally registered in the busy list in the flash memory 48 only at a timing when the ink consumption amount has exceeded any of the plurality of prescribed values set in advance (for example, 10%, 30%, 50%, 70%, and 90%). However, it is possible to appropriately determine the possibility that a fault has been generated in the circuits including the memories of the individual cartridges using the ink consumption amount with a number of times of registering which are limited in this manner.

Additionally, as the fault countermeasure process in relation to the memory device 200, if the ink consumption amount IC-BL stored in the flash memory 48 is written into the memory device 200 of the cartridge, in the case where a memory error is generated in the cartridge, it is possible to change the ink consumption amount in the memory device 200 to a more accurate value.

When a user performs a printing instruction after the cartridge checking is completed, the printing operation in step S140 of FIG. 6 is executed. At this time, the ink consumption amount calculating section 42 calculates the ink consumption amount (an accumulated value of the used amount of ink) of each of the cartridges according to the used amount of each ink used in printing. In step S150, the main control section 40 changes the storing of the ink consumption amount of each cartridge mounted in the printer 20.

Figure 8:
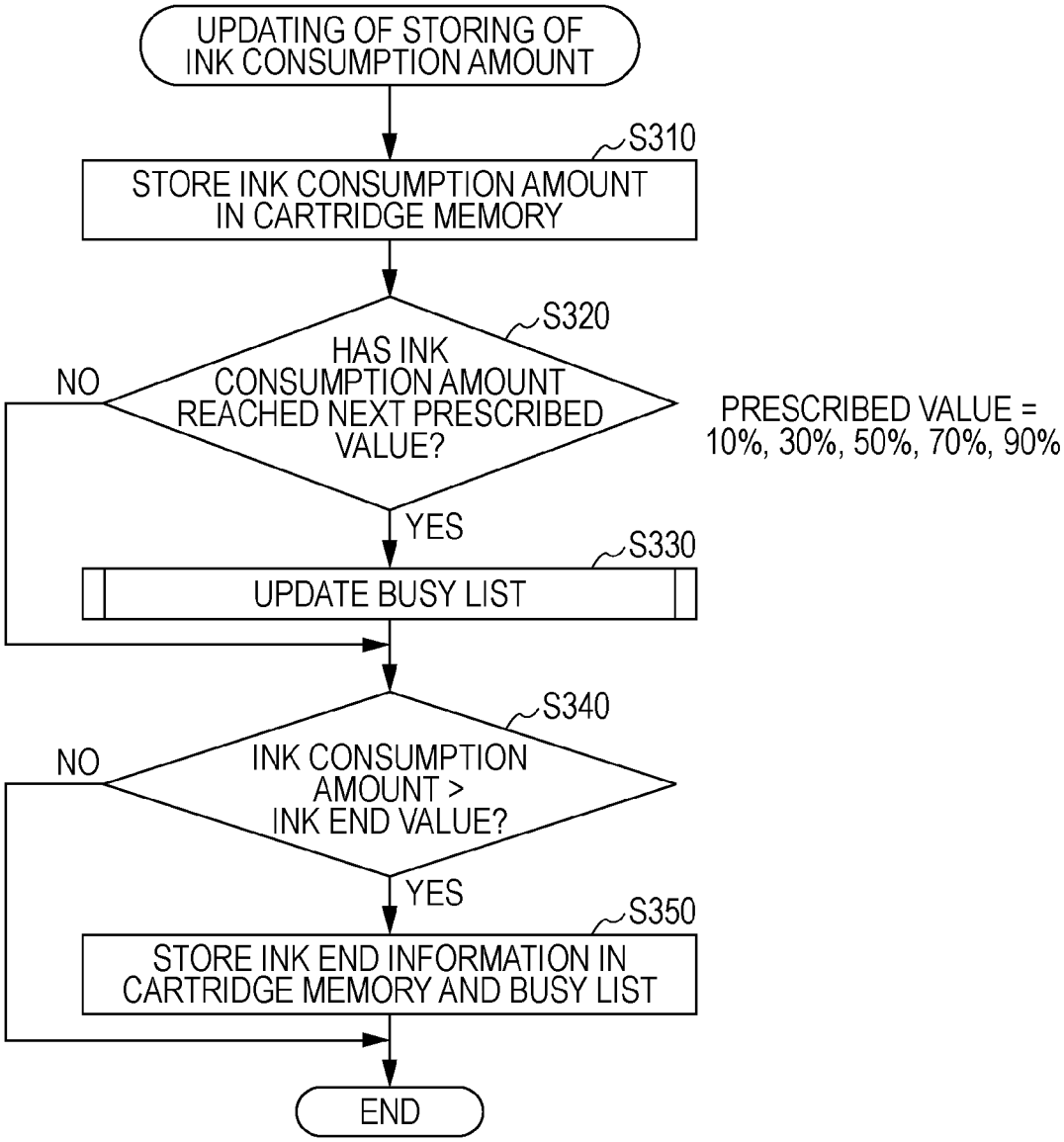
FIG. 8 is a flow chart illustrating a detailed sequence of updating of storing of the ink consumption amount.

FIG. 8 is a flow chart illustrating a detailed sequence of updating of storing of the ink consumption amount. In step S310, the ink consumption amount calculated in step S140 of FIG. 6 is written into the memory devices 200 of each of the cartridges. In step S320, the busy list updating section 44 determines whether or not the ink consumption amount has reached the next prescribed value of the plurality of prescribed values (10%, 30%, 50%, 70%, and 90%). For example, after it is determined that the ink consumption amount has reached 10% which is the initial prescribed value, it is determined that the ink consumption amount has not reached the next prescribed value until 30% which is the next prescribed value is reached. In a case where the ink consumption amount reaches the next prescribed value, the updating process of the busy list is executed in step S330. The updating process of the busy list is a process described in FIGS. 3 to 5B described above. That is, in the updating process of the busy list, in the case where the ink consumption amount of the mounted ink cartridge has reached the next prescribed value, one grouping of the cartridge information which includes the unique ID and the ink consumption amount of the ink cartridge is added to the busy list in the flash memory 48. Additionally, at this time, when the sector (busy list buffer), which is the writing target out of the plurality of sectors in the flash memory 48, has become full, the reconfiguration of the busy list buffer is executed (FIG. 4B→FIG. 4C and FIG. 5A→FIG. 5B).

In step S340, it is determined whether or not the ink consumption amount has exceeded the ink end value (for example, 99%). In a case where the ink end value is exceeded, the main control section 40 stores the ink end information in both the memory device 200 of the cartridge and the busy list in the flash memory 48. Here, the ink end information may be stored in only either one of the memory device 200 of the cartridge or the busy list in the flash memory 48, or the ink end information may be stored in neither. In addition, the process of FIG. 8 is executed with regard to each individual cartridge mounted in the printer 20.

When the updating of the storing of the ink consumption amount in this manner is completed, the main control section 40 determines whether or not there is the cartridge where the ink end has been reached in step S160 of FIG. 6. In a case where there is the cartridge where the ink end has been reached, a display prompting the exchange of cartridges is displayed on the display section 72 of the printer 20 or a screen of the computer 90. Then, in a case where the cartridge is actually exchanged, the processes from step S130 onward are executed again. On the other hand, in a case where there is no cartridge where the ink end has been reached, the flow of processes is returned to step S140 and the processes of steps S140 to S160 described above are repeatedly executed until the power of the printer 20 is turned off. When the power of the printer 20 is turned off (S170), the main control section 40 copies the busy list address BLA from the main memory (not shown) to the EEPROM 46 (S180).

In this manner, in the embodiment, the cartridge information including the ink consumption amount of the ink cartridge is stored using the flash memory which is cheap compared to the EEPROM. In particular, since the timing of additional registering of the cartridge information including the ink consumption amount in the flash memory is limited to a point in time when the ink consumption amount reaches any of the plurality of prescribed values set in advance, it is possible to significantly reduce the memory capacity required in the flash memory.

Additionally, in the embodiment, in the case where the ink consumption amount stored in the flash memory is larger than the ink consumption amount stored in the memory of the cartridge, it is determined that there is a high possibility that a fault has been generated in the circuits including the memory of the cartridge. On the other hand, in the case where the ink consumption amount stored in the flash memory is equal to or less than the ink consumption amount stored in the memory of the cartridge, since it is possible to determine that the ink consumption amount stored in the memory of the cartridge is the correct value, it is possible to appropriately calculate the ink consumption amount afterwards using the ink consumption amount.

Furthermore, since the cartridge information including the unique ID which uniquely distinguishes the cartridge and the ink consumption amount are sequentially stored in the busy list buffer, when a cartridge is mounted where the unique ID is not registered in the busy list buffer, it is possible to be correctly recognized as a new cartridge. Accordingly, it is possible to correctly perform the exchange cleaning (process of filling ink into the ink path) to be executed in the case where a new cartridge is mounted.

MODIFIED EXAMPLES

In addition, the invention is not limited to the application examples or the embodiment described above but various embodiments are possible within the scope without departing from the gist of the invention, and for example, the following modifications can be made.

Modified Example 1

In the embodiment described above, the ink consumption amount (an accumulated value of the used amount of ink) is stored in the cartridge and in the memory of the printer. However, instead of this, the remaining amount of ink in the cartridge may be stored. Typically, it is possible to calculate and store in the memory the ink usage information relating to the consumption amount and the remaining amount of ink.

Modified Example 2

In the embodiment described above, a new grouping of the cartridge information including the unique ID and the ink consumption amount of the cartridge are added in the busy list buffer only when the ink consumption amount of the cartridge reaches any of the plurality of prescribed values set in advance. However, a new grouping of the cartridge information may be added in the busy list at a different timing. For example, a new grouping of the cartridge information may be added in the busy list every constant period of time. However, even in this case, it is preferable if the ink consumption amount is updated more frequently than the busy list (that is, the latest ink consumption amount is written in). Here, it is possible to set each type of frequency set in advance so that the frequency of updating the ink consumption amount in the memory device of the cartridge is performed for every constant period of time or constant amount of printing (for example, one page).

Modified Example 3

In the embodiment described above, when the relationship between the latest ink consumption amount IC-BL registered in the busy list and the ink consumption amount IC-CM which is read out from the memory device of the cartridge is IC-BL>IC-CM, it is determined that a fault has been generated in the circuits including the memory device of the cartridge (step S240 of FIG. 7). However, typically, in a case where the relationship of the two ink consumption amounts IC-BL and IC-CM is outside of a permitted range set in advance, it is possible to determine that some type of fault has been generated. For example, in a case where the difference between IC-BL and IC-CM exceeds the permitted range (for example, ±10%) set in advance, it may be determined that a fault has been generated.

Modified Example 4

Out of each of the constituent elements described in the embodiment described above, it is possible to not include constituent elements which have no relation to a particular object, action, or effect. For example, the sub control section 50 (FIG. 2) may not be provided.

Modified Example 5

In the embodiment described above, an ink jet type of printing device and ink cartridge has been adopted. However, a liquid ejecting apparatus which ejects or discharges a different liquid other than ink or a liquid container which supplies liquid to a liquid ejecting apparatus may be adopted. The liquid referred to here includes a fluid body such as a gel or liquid body where particles of functional materials are dispersed in a solvent. For example, a liquid ejecting apparatus which ejects a liquid with a material in a dispersed or dissolved form such as an electrode material or a colorant used in manufacturing liquid crystal displays, EL (electroluminescence) displays, surface emitting displays or color filters, a liquid ejecting apparatus which ejects a biological organic material used in manufacturing biochips, or a liquid ejecting apparatus which used as a precision pipette which ejects a liquid which is a sample may be adopted. Furthermore, a liquid ejecting apparatus which precisely ejects lubrication oil in a precision device such as a watch or a camera, a liquid ejecting apparatus which ejects a transparent resin liquid such as an ultraviolet curing resin onto a substrate to form, for example, miniature hemispherical lenses (optical lenses) used in optical communication elements and the like, a fluid ejecting apparatus which ejects an acidic or alkaline etching liquid to perform etching of substrates and the like, or a liquid container which supplies liquid to these liquid ejecting apparatuses may be adopted. Then, it is possible to apply the invention to any one type of the ejecting apparatus and the liquid container. Furthermore, the invention is not limited to an ink jet type of printer and it is also possible to apply the invention also to a laser printer or a toner cartridge which execute printing using a recording material such as toner.

The entire disclosure of Japanese Patent Application No. 2010-143586, filed Jun. 24, 2010 is expressly incorporated by reference herein.

What is claimed is:

1. A liquid ejecting apparatus, which is able to be mounted with a cartridge which is provided with a memory device which stores liquid usage information relating to a consumption amount or a remaining amount of liquid accommodated in the cartridge and a unique ID which uniquely distinguishes the cartridge, comprising:

a non-volatile memory for storing cartridge information including the unique ID of the cartridge and the liquid usage information relating to the cartridge mounted one or more times in the liquid ejecting apparatus;

a control section which controls the non-volatile memory and the memory device of the cartridge mounted, wherein the control section performs writing which updates the liquid usage information more frequently in the memory device of the cartridge than in the non-volatile memory; and wherein the control section is configured to execute a fault countermeasure process in relation to the memory device of the cartridge in a case where a relationship between a first liquid consumption amount obtained from the liquid usage information stored in the memory device of the cartridge mounted in the liquid ejecting apparatus and a second liquid consumption amount obtained from the liquid usage information stored in the non-volatile memory with regard to the cartridge is outside of a permitted range set in advance.

2. The liquid ejecting apparatus according to claim 1, wherein the control section determines, in a case where the second liquid consumption amount is larger than the first liquid consumption amount, that the relationship between the first and second liquid consumption amounts is outside of the permitted range and executes the fault countermeasure process.

3. The liquid ejecting apparatus according to claim 2, wherein the control section executes a process of storing the liquid usage information, which is stored in the non-volatile memory, in the memory device of the cartridge as the fault countermeasure process.

4. The liquid ejecting apparatus according to claim 1, wherein the non-volatile memory is a flash memory, and the control section adds a grouping of the unique ID of the cartridge and the liquid usage information in the flash memory as a new grouping of the cartridge information only when the consumption amount or the remaining amount of the liquid relating to the cartridge mounted in the liquid ejecting apparatus has reached a plurality of prescribed values set in advance.

5. The liquid ejecting apparatus according to claim 1, wherein the non-volatile memory is a flash memory which has a plurality of sectors, and the control section selects one out of the plurality of sectors as a writing sector and executes an addition of the cartridge information, and in a case when the writing sector has become full, only the latest cartridge information of each unique ID is selected out of a plurality of groups of cartridge information stored in the writing sector and the selected cartridge information is written into a sector which is next after the writing sector and the next sector is selected as the new writing sector.

6. The liquid ejecting apparatus according to claim 5, wherein, in a case where the writing sector has become full, the control section deletes the cartridge information, which shows that the liquid usage information has exceeded an upper limit value of the consumption amount of the liquid, and the cartridge information, which includes the unique ID which is the same as the cartridge information out of the plurality of groupings of cartridge information stored in the writing sector, from the cartridge information which is to be written into the next sector.

7. A control method of a liquid ejecting apparatus, which is able to be mounted with a cartridge which is provided with a memory device which stores liquid usage information relating to a consumption amount or a remaining amount of liquid accommodated in the cartridge and a unique ID which uniquely distinguishes the cartridge, comprising:

storing cartridge information, including the unique ID of the cartridge and the liquid usage information relating to the cartridge mounted one or more times in the liquid ejecting apparatus, in a non-volatile memory;

updating the liquid usage information more frequently in the memory device of the cartridge than in the non-volatile memory; and executing a fault countermeasure process in relation to circuits which include the memory device of the cartridge in a case where a relationship between a first liquid consumption amount obtained from the liquid usage information stored in the memory device of the cartridge mounted in the liquid ejecting apparatus and a second liquid consumption amount obtained from the liquid usage information stored in the non-volatile memory with regard to the cartridge is outside of a permitted range set in advance.

* * * * *